US008994596B2

(12) United States Patent
Du et al.

(10) Patent No.: US 8,994,596 B2
(45) Date of Patent: Mar. 31, 2015

(54) MULTI-BAND ANTENNA

(75) Inventors: Jian-Jhih Du, Taipei (TW); Kuo-Chang Lo, Miaoli County (TW); Chih-Yung Huang, Taichung (TW)

(73) Assignee: Arcadyan Technology Corporation, Hsinchu (TW)

( * ) Notice: Subject to any disclaimer, the term of this patent is extended or adjusted under 35 U.S.C. 154(b) by 225 days.

(21) Appl. No.: 13/557,397

(22) Filed: Jul. 25, 2012

(65) Prior Publication Data

US 2013/0033413 A1 Feb. 7, 2013

(30) Foreign Application Priority Data

Aug. 4, 2011 (TW) ..... 100127804 A

(51) Int. Cl.
*H01Q 1/24* (2006.01)
*H01Q 5/00* (2006.01)
*H01Q 9/42* (2006.01)

(52) U.S. Cl.
CPC ..... *H01Q 1/243* (2013.01); *H01Q 5/0058* (2013.01); *H01Q 5/0062* (2013.01); *H01Q 5/0072* (2013.01); *H01Q 9/42* (2013.01)
USPC ..... 343/702; 343/700 MS

(58) Field of Classification Search
CPC ... H01Q 1/243; H01Q 5/0058; H01Q 5/0062; H01Q 5/0072; H01Q 9/42
USPC ..... 343/700 MS, 702, 846
See application file for complete search history.

(56) References Cited

U.S. PATENT DOCUMENTS

| | | | | |
|---|---|---|---|---|
| 7,050,010 | B2 * | 5/2006 | Wang et al. | 343/702 |
| 7,768,460 | B2 | 8/2010 | Yang et al. | |
| 7,830,326 | B2 | 11/2010 | Hung et al. | |
| 7,868,831 | B2 | 1/2011 | Hung et al. | |
| 7,928,912 | B2 | 4/2011 | Chen et al. | |
| 7,928,916 | B2 | 4/2011 | Hung et al. | |
| 7,990,321 | B2 | 8/2011 | Shih | |
| 8,223,075 | B2 * | 7/2012 | Pan | 343/700 MS |
| 2007/0176835 | A1 | 8/2007 | Qi et al. | |
| 2008/0180333 | A1 * | 7/2008 | Martiskainen et al. | 343/722 |

(Continued)

FOREIGN PATENT DOCUMENTS

| | | | |
|---|---|---|---|
| CN | 1753248 | A | 3/2006 |
| CN | 101783435 | A | 7/2010 |

(Continued)

*Primary Examiner* — Hoanganh Le
(74) *Attorney, Agent, or Firm* — Rabin & Berdo, P.C.

(57) ABSTRACT

A multi-band inverted-F antenna including a ground plane, a signal feeding circuit, first, second and third main radiation parts is provided. The signal feeding circuit is electrically isolated from the ground plane and receives/transmits wireless signals. The first and the second main radiation part are both physically and electrically connected to the signal feeding circuit, and generate first and second frequency band operation modes for the inverted-F antenna, respectively. The third main radiation part is electrically isolated from the signal feeding circuit, the first and the second main radiation parts, and generates a third frequency band operation mode for the inverted-F antenna via to signal coupling between the first and the third main radiation parts and/or signal coupling between the second and the third main radiation parts.

13 Claims, 12 Drawing Sheets

(56) References Cited

U.S. PATENT DOCUMENTS

| | | | |
|---|---|---|---|
| 2010/0026585 | A1 | 2/2010 | Pan |
| 2010/0123631 | A1 | 5/2010 | Chang et al. |
| 2010/0214174 | A1 | 8/2010 | Guan et al. |
| 2010/0265157 | A1 | 10/2010 | Yang et al. |
| 2010/0283685 | A1 | 11/2010 | Tsai et al. |
| 2010/0315294 | A1 | 12/2010 | Chang et al. |
| 2011/0001681 | A1 | 1/2011 | Hsu |
| 2011/0032166 | A1 | 2/2011 | Zhang et al. |
| 2011/0074636 | A1 | 3/2011 | Tsai et al. |

FOREIGN PATENT DOCUMENTS

| | | | |
|---|---|---|---|
| EP | 1641077 | A1 | 3/2006 |
| EP | 2202845 | A1 | 6/2010 |
| TW | 575979 | B | 2/2004 |
| TW | M326712 | U | 2/2008 |
| WO | WO-2010090573 | A1 | 8/2010 |
| WO | WO-2011059088 | A1 | 5/2011 |

* cited by examiner

MULTI-BAND ANTENNA

This application claims the benefit of Taiwan application Serial No. 100127804, filed Aug. 4, 2011, the subject matter of which is incorporated herein by reference.

BACKGROUND PLANE

1. Technical

The application relates in general to a multi-band inverted-F antenna.

2. Description of the Related Art

To satisfy mobility requirement, wireless communication products are directed towards miniaturization and light-weight. The interior of a wireless communication device has limited space available for antenna. For a hidden antenna, antenna size and function have much to do with the consumer's acceptance of the product.

Inverted-F antenna is a popular hidden antenna, which can be hidden in a mobile phone, a personal digital assistant (PDA), or a notebook computer. Conventional inverted-F antenna mainly includes: a main radiation part, a signal feeding circuit and a short-circuit line connected to ground plane. However, conventional inverted-F antenna still has many issues to resolve, for example narrow bandwidth, and complicated and easily-deformed structure.

SUMMARY OF THE APPLICATION

The application is directed to an inverted-F antenna with a miniaturized structure. Dual oscillation frequencies are achieved by two main radiation parts. Via coupling effect of a slot, and a metal radiation part extended from ground plane, a third resonance band is formed.

According to an exemplary embodiment of the present application, a multi-band inverted-F antenna including a ground plane, a signal feeding circuit, a first main radiation part, a second main radiation part, and a third main radiation part is provided. The signal feeding circuit, electrically isolated from the ground plane, receives/transmits wireless signals. The first main radiation part, physically and electrically connected to the signal feeding circuit, generates a first band operation mode for the inverted-F antenna. The second main radiation part, physically and electrically connected to the signal feeding circuit, generates a second band operation mode for the inverted-F antenna. The third main radiation part is extended from the ground plane and is electrically isolated from the signal feeding circuit, the first main radiation part and the second main radiation part. The third main radiation part generates a third band operation mode for the inverted-F antenna via a signal coupling between the first and the third main radiation parts and/or a signal coupling between the second and the third main radiation parts.

The above and other contents of the application will become better understood with regard to the following detailed description of the preferred but non-limiting embodiment (s). The following description is made with reference to the accompanying drawings.

DETAILED DESCRIPTION OF EMBODIMENTS OF THE APPLICATION

In embodiments of the application, dual oscillation frequencies are achieved by two main radiation parts. Via coupling effect of a slot, and a metal radiation part extended from ground plane, a third resonance band is formed and bandwidth is thus increased.

Figure 1:
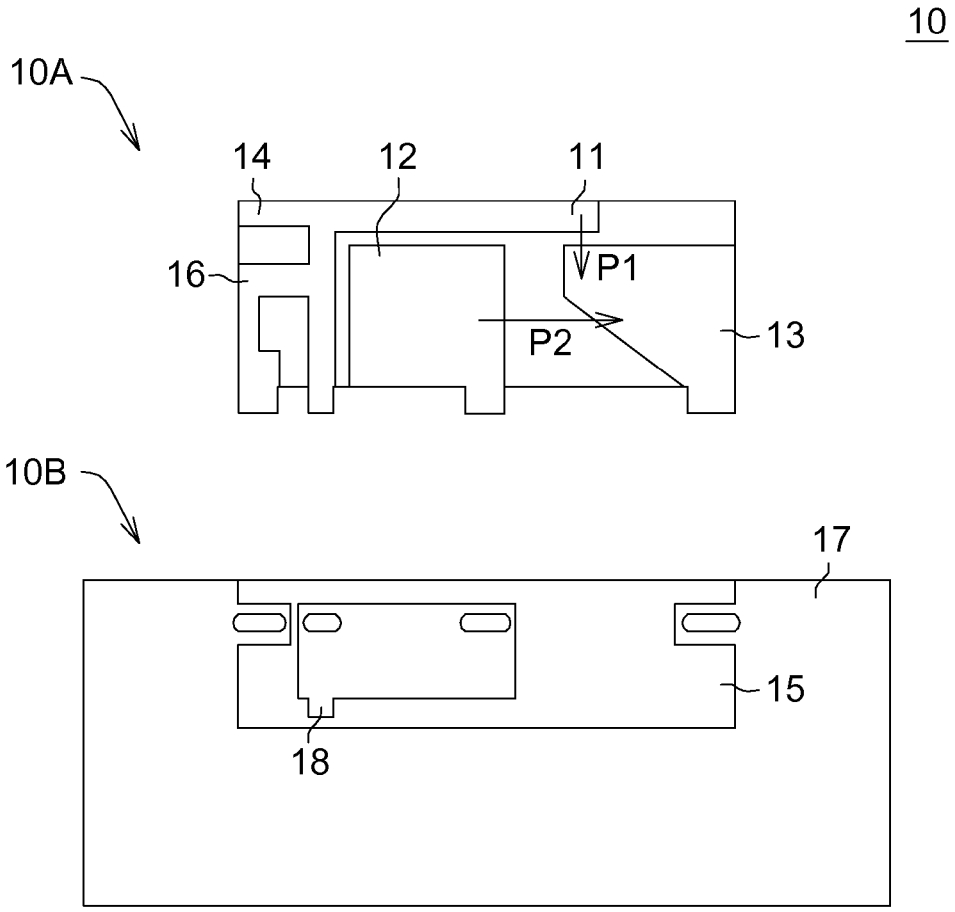
FIGS. 1 and 2 respectively show a plan view and a stereoscopic view of an inverted-F antenna according to an embodiment of the application.
Figure 2:
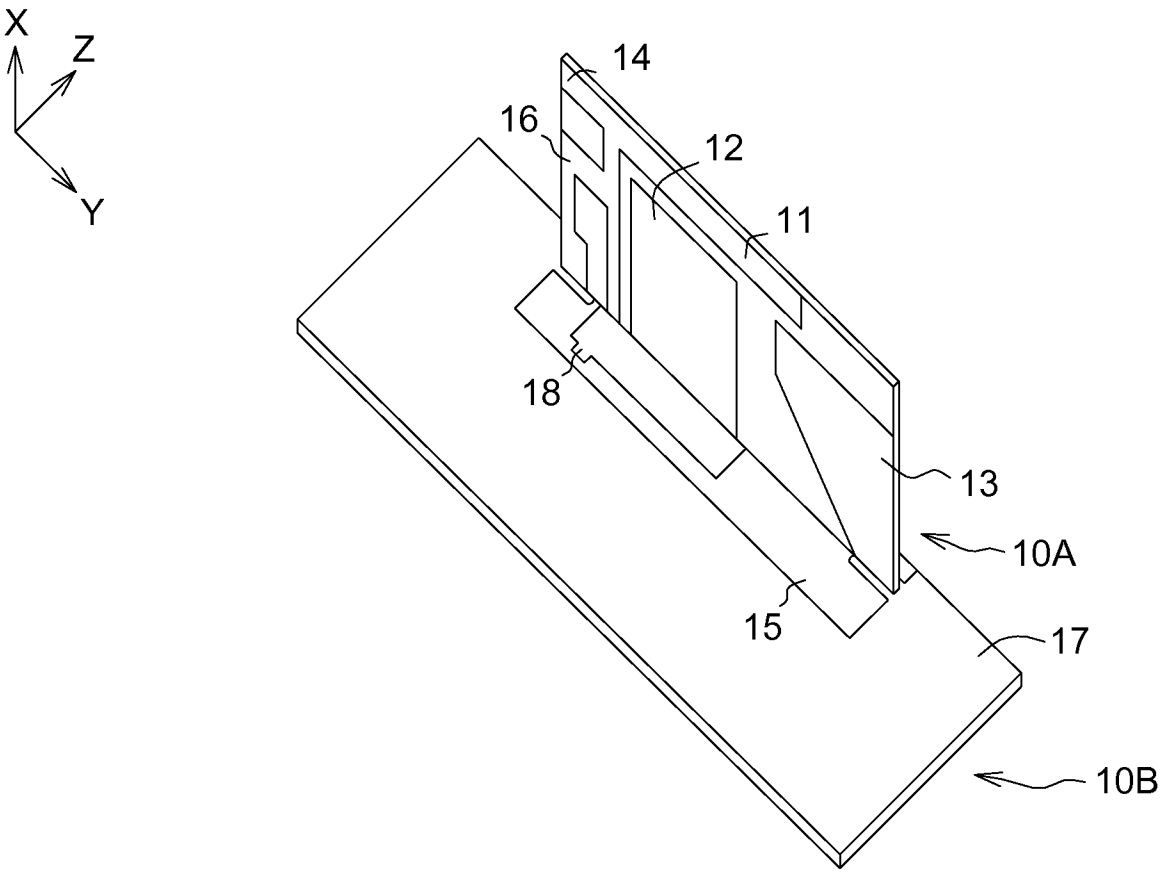

Referring to FIGS. 1 and 2, a plan view and a stereoscopic view of an inverted-F antenna according to an embodiment of the application are respectively shown. As indicated in FIGS. 1 and 2, an inverted-F antenna 10 of the embodiment of the application includes main radiation parts 11~13, a low-band impedance match 14, a slot 15, a short-circuit line 16, a ground plane 17 and a signal feeding circuit 18.

The inverted-F antenna 10 of the embodiment of the application in FIG. 1 includes two printed circuit boards (PCB) 10A and 10B. The main radiation parts 11~13, the low-band impedance match 14 and the short-circuit line 16 are on the PCB 10A. The slot 15, the ground plane 17 and the signal feeding circuit 18 are on the PCB 10B.

As indicated in FIG. 2, the PCB 10A is vertically inserted into the PCB 10B. That is, after assembly, the PCB 10A and the PCB 10B form an L-shaped structure. Thus, overall height of the inverted-F antenna 10 is reduced without affecting its radiation efficiency.

The main radiation part 11 is as a main radiation part for a first band of the inverted-F antenna 10. The main radiation part 11 is for generating a first frequency band operation mode. The first frequency band is normally a low-frequency band, exemplarily but not restrictively, between 824 MHz~960 MHz. The first frequency band may be adjusted through adjustment in the dimension of the main radiation part 11. The main radiation part 11 is physically and electrically connected to the signal feeding circuit 18 for receiving/transmitting wireless signals. In the present embodiment of the application, the main radiation part 11 has a meander extended towards the signal feeding circuit 18, and the size of the main radiation part 11 is effectively reduced.

The main radiation part 12 is used as a main radiation part for a second frequency band of the inverted-F antenna 10. The second frequency band is normally a medium frequency band, exemplarily but not restrictively, between 1710 MHz~18xx MHz. In the present embodiment of the application, the main radiation part 12 is adjacent to the meander of the main radiation part 11. The main radiation part 12 generates a second frequency band operation mode for the inverted-F antenna. The second frequency band may be adjusted through adjustment in the dimension of the main radiation part 12. The main radiation part 12 is physically and electrically connected to the signal feeding circuit 18 for receiving/transmitting wireless signals.

The main radiation part 13 is as a main radiation part for a third frequency band of the inverted-F antenna 10. The third frequency band is normally a high-frequency band, exemplarily but not restrictively, between 18xx MHz~2170 MHz. The main radiation part 13 generates a third frequency band operation mode for the inverted-F antenna. The third frequency band may be adjusted through adjustment in the dimension of the main radiation part 13. The main radiation part 13 is extended from the ground plane 17 and adjacent to the main radiation part 11 and the main radiation part 12. The main radiation part 13 is electrically isolated from the signal feeding circuit 18, the main radiation part 11 and the second main radiation part 12. However, via signal coupling paths P1 and P2, the main radiation part 13 may be used as a high-frequency band main radiation part of the inverted-F antenna 10. The signal coupling path P1 is formed between the main radiation part 11 and the main radiation part 13, for signal coupling between the main radiation part 11 and the main radiation part 13. The signal coupling path P2 is formed between the main radiation part 12 and the main radiation part 13 for signal coupling between the main radiation part 12 and the main radiation part 13. In other words, a slot is formed between the main radiation part 11 and the main radiation part 13, and another slot is formed between the main radiation part 12 and the main radiation part 13. The third frequency band may be adjusted through adjustment in the dimension of the main radiation part 13. Via the main radiation part 13, the bandwidth of the inverted-F antenna 10 of the embodiment of the application is increased.

The low-frequency band impedance match 14 is extended from the main radiation part 11 and is used for impedance match. In the present embodiment of the application, the low-frequency band impedance match 14 is optional and is extended away from the meander of the main radiation part 11.

The slot 15, formed on the PCB 10B, is formed between the main radiation part 13, the ground plane 17 and the signal feeding circuit 18. The slot 15 is for high-frequency impedance match.

The short-circuit line 16 is used as short-circuit of the inverted-F antenna 10 and also used for adjusting impedance match. In the present embodiment of the application, the short-circuit line 16 is electrically connected to the meander of the main radiation part 11, which is adjacent to the short-circuit line 16.

The ground plane 17 is used as a ground plane for the inverted-F antenna 10. The inverted-F antenna 10 is electrically connected to the ground plane 17 through the short-circuit line 16. The signal feeding circuit 18 feeds wireless signals to the main radiation parts 11 and 12, and receives wireless signals received by the main radiation parts 11 and 12.

The inverted-F antenna of the embodiment of the application includes printed circuit boards, so the inverted-F antenna has a robust structure and does not deform easily. For compatible with a lot of wireless systems, the inverted-F antenna of the embodiment of the application may adjust its oscillation frequency to achieve a suitable frequency bandwidth.

Besides, the dimension of the inverted-F antenna of the embodiment of the application may be reduced to be about 0.16 λ.

Figure 3A:
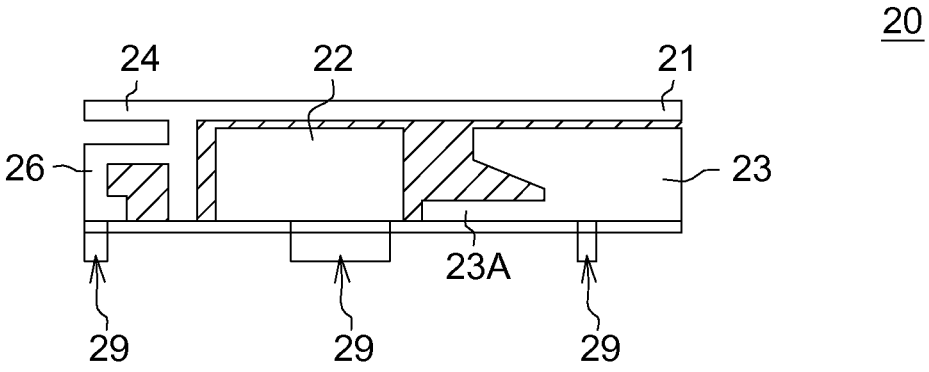
FIGS. 3A and 3B respectively show a front view and a top view of an inverted-F antenna according to another embodiment of the application.
Figure 3B:
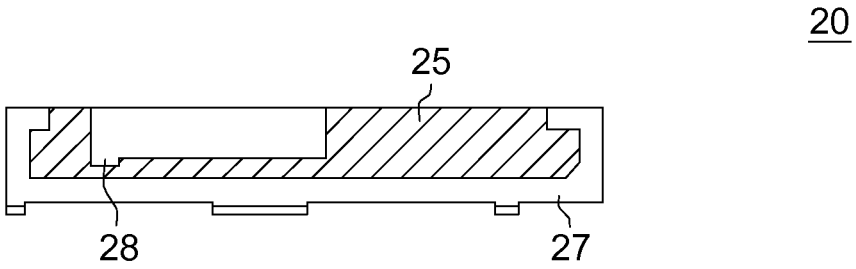

Referring to FIGS. 3A and 3B, a front view and a top view of an inverted-F antenna 20 according to another embodiment of the application are respectively shown. As indicated in FIGS. 3A and 3B, the inverted-F antenna 20 of the application includes: main radiation parts 21~23, low-frequency band impedance match 24, a slot 25, a short-circuit line 26, a ground plane 27, a signal feeding circuit 28 and a pin 29. In FIGS. 3A and 3B, slashed regions denote hollowed regions.

Operations and functions of the main radiation parts 21~23, the low-frequency band impedance match 24, the slot 25, the short-circuit line 26, the ground plane 27 and the signal feeding circuit 28 of the inverted-F antenna 20 are the same or similar with that of the inverted-F antenna 10, and the details are not repeated here. To improve impedance match, the main radiation part 23 further includes an impedance match 23A. The impedance match 23A is extended from the main radiation part 23 and is for impedance matching for the third band. Via the pin 29, the inverted-F antenna 20 of the application may be inserted into circuit board (not illustrated) of wireless communication devices.

A part or a totality of the inverted-F antenna 20 of the application may be formed by metal pieces (for example iron pieces) to reduce cost. For example, the main radiation parts 21~23, the impedance match 23A, the low-band impedance match 24, the short-circuit line 26 and the pin 29 are on an iron piece, while the slot 25, the ground plane 27 and the signal feeding circuit 28 are on another iron piece. The two iron pieces may form an L shape.

Figure 4A:
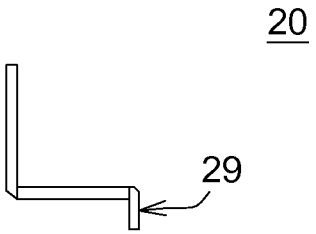
FIGS. 4A and 4B respectively show a left side view and a right side view of the inverted-F antenna in FIGS. 3A and 3B.
Figure 4B:
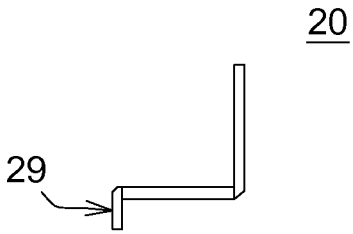
Figure 5A:
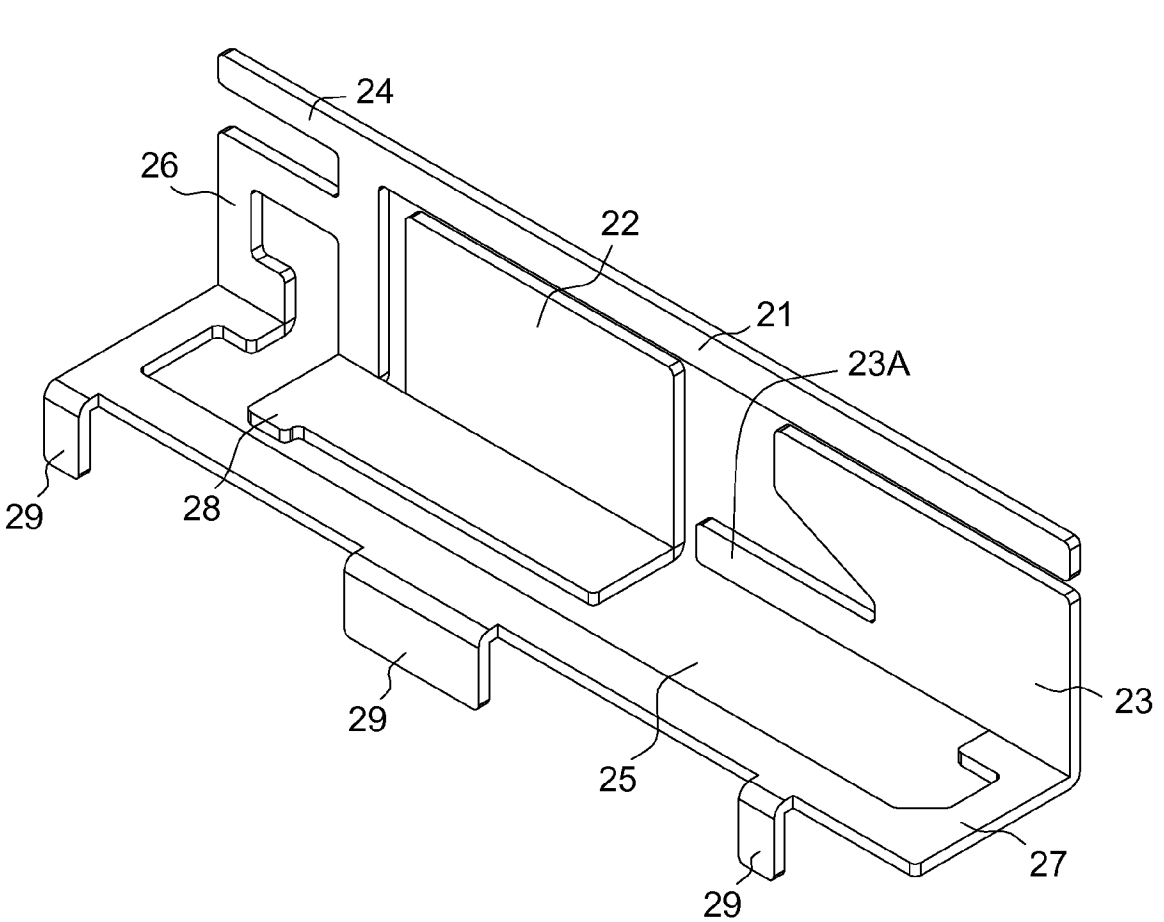
FIGS. 5A and 5B respectively show stereoscopic views of the inverted-F antenna in FIGS. 3A and 3B.
Figure 5B:
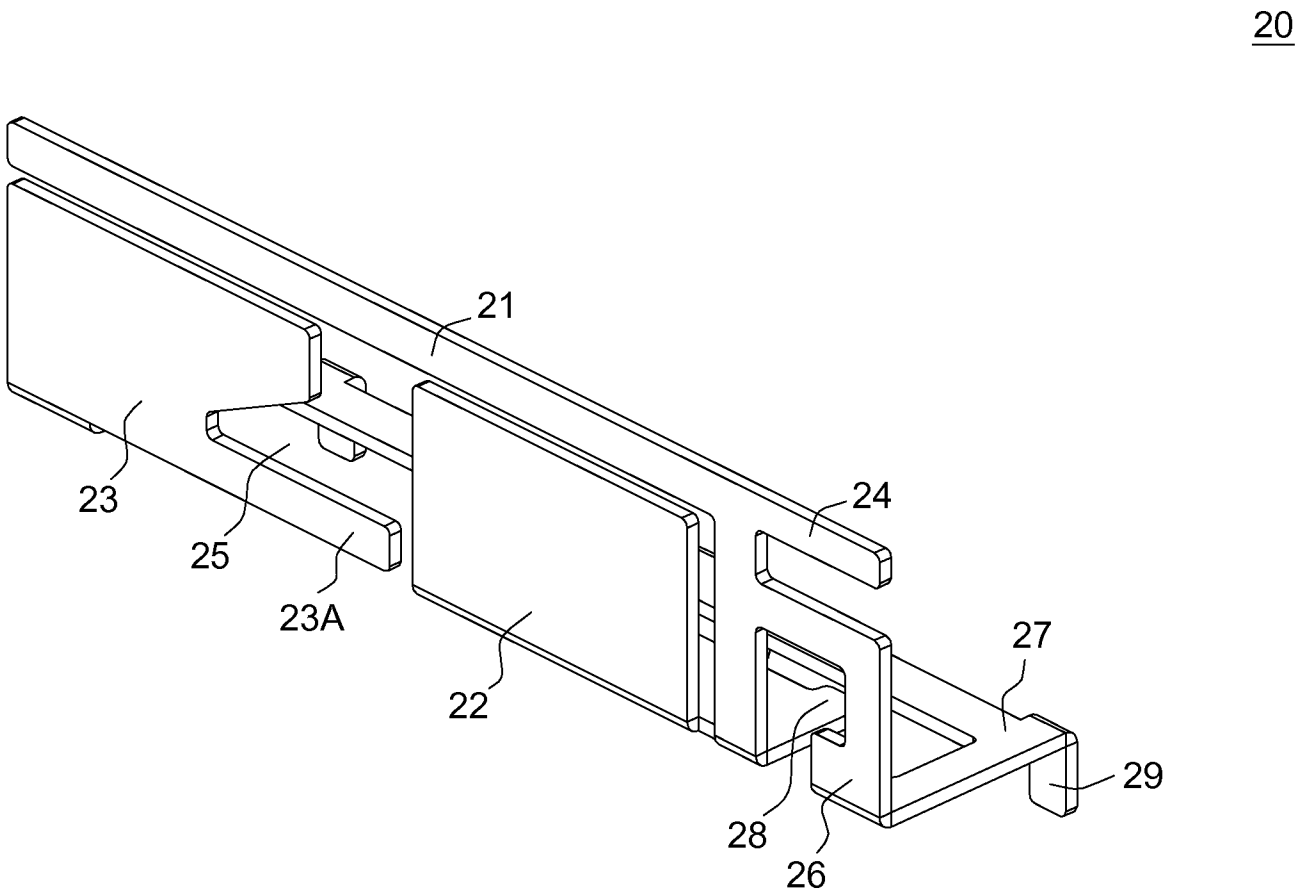

FIGS. 4A and 4B respectively show a left side view and a right side view of the inverted-F antenna 20 of the application. FIGS. 5A and 5B respectively show two stereoscopic views of the inverted-F antenna 20. As indicated in FIGS. 4A, 4B, 5A and 5B, the appearance of the inverted-F antenna 20 of the application is L-shaped, so that the overall height of the L inverted-F antenna 20 is reduced without affecting its radiation efficiency.

To compatible with different wireless communication systems, the inverted-F antenna 20 of the application may adjust its oscillation frequency for a suitable bandwidth.

Figure 6:
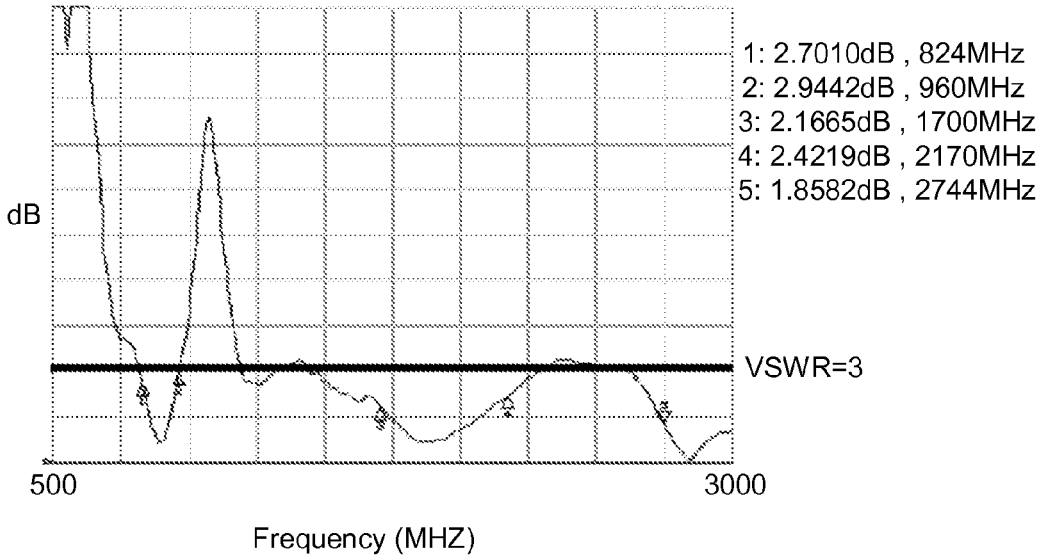
FIG. 6 shows a VSWR experiment diagram of the inverted-F antenna according to the above two embodiments of the application.
Figure 7A:
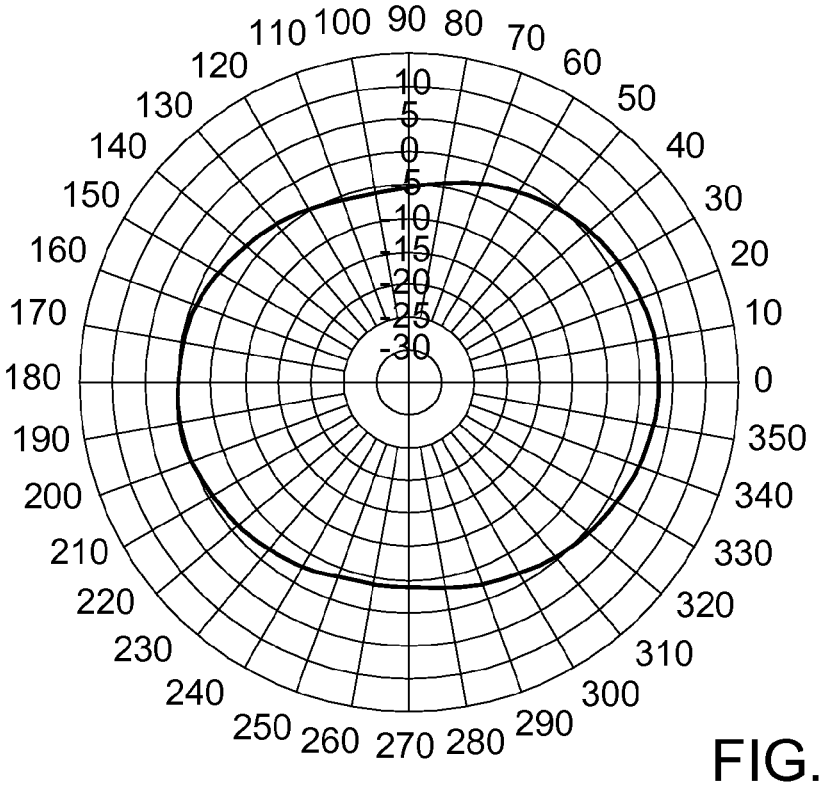
FIGS. 7A~7D, FIGS. 8A~8D and FIGS. 9A~9D show radiation patterns of total gain polarization (horizontal polarization and vertical polarization) of the inverted-F antennas according to the above two embodiments of the application.
Figure 7B:
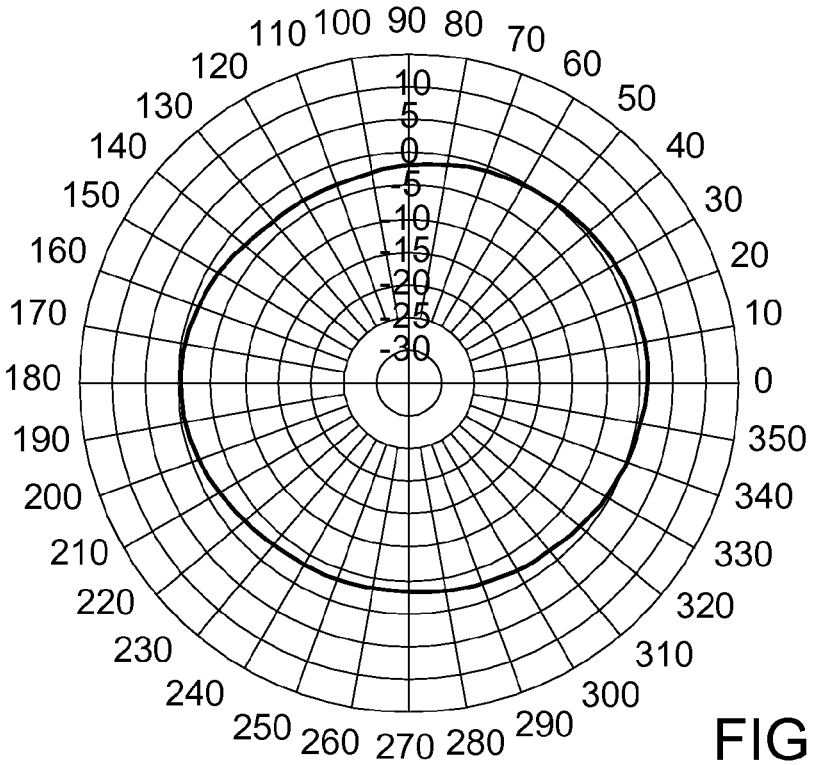
Figure 7C:
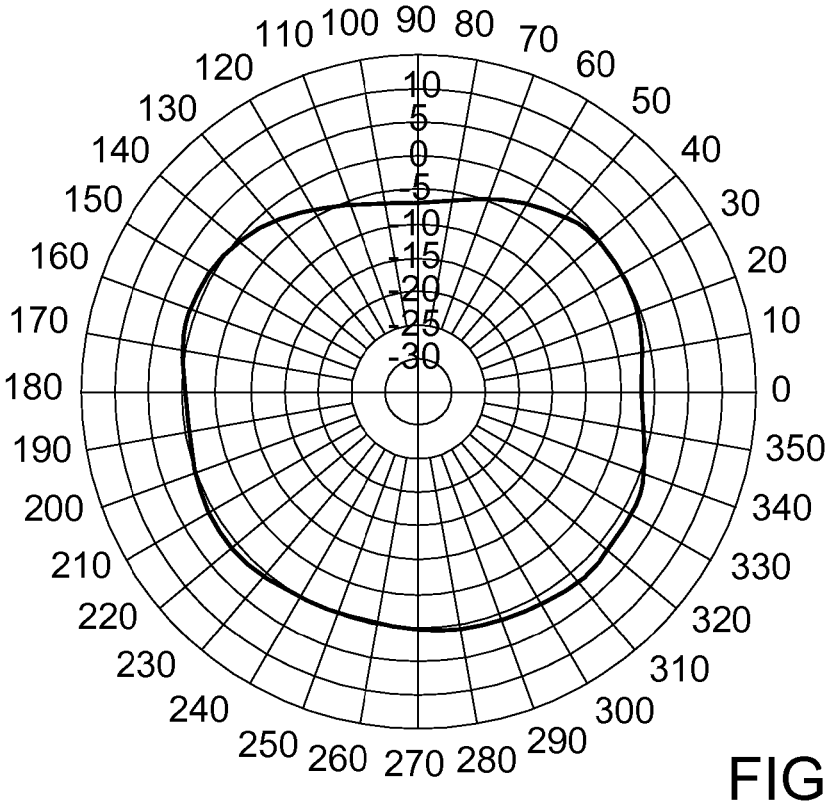
Figure 7D:
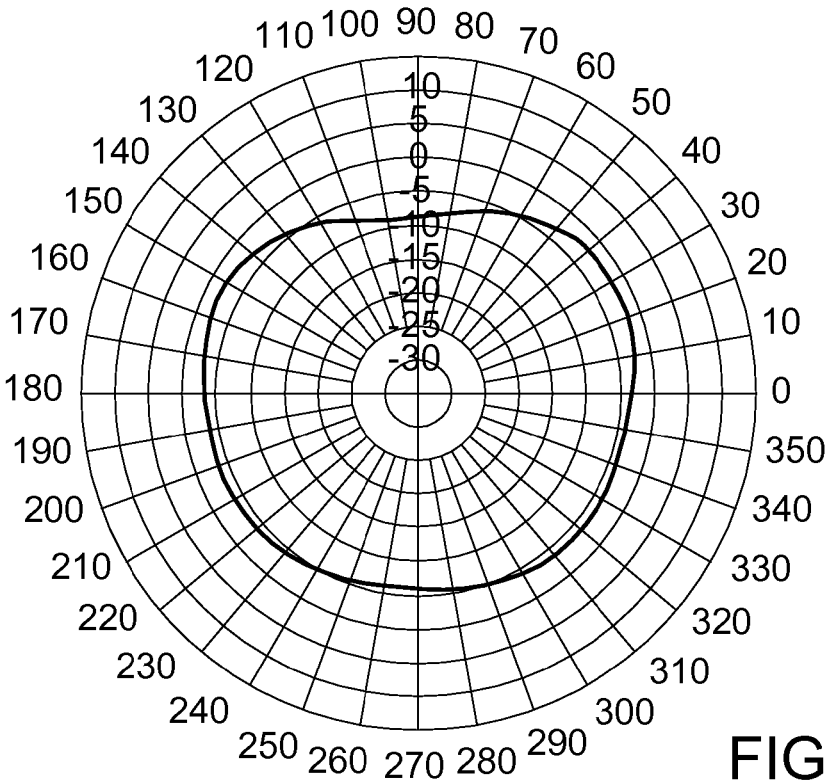
Figure 8A:
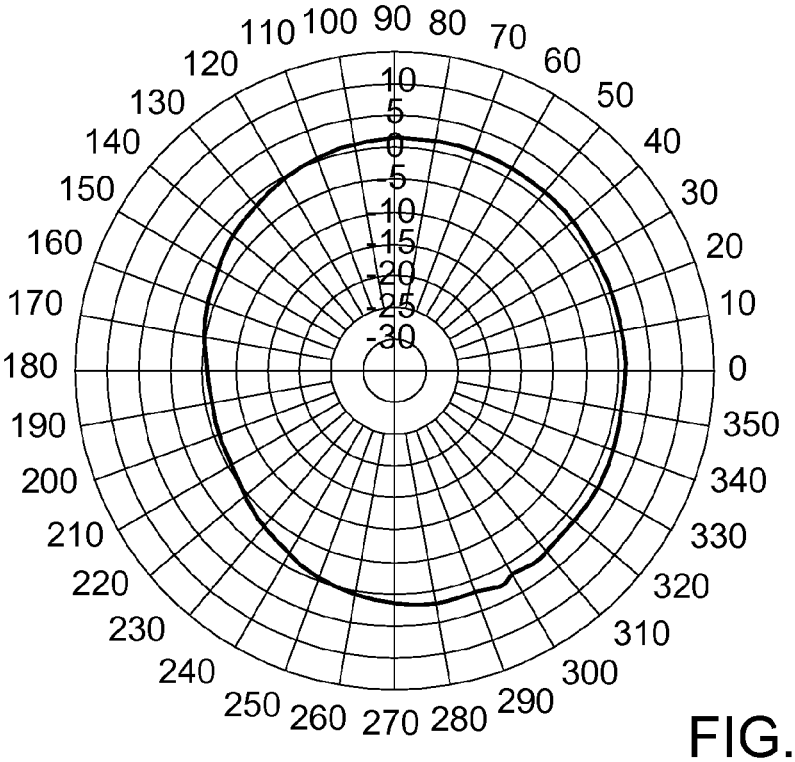
Figure 8B:
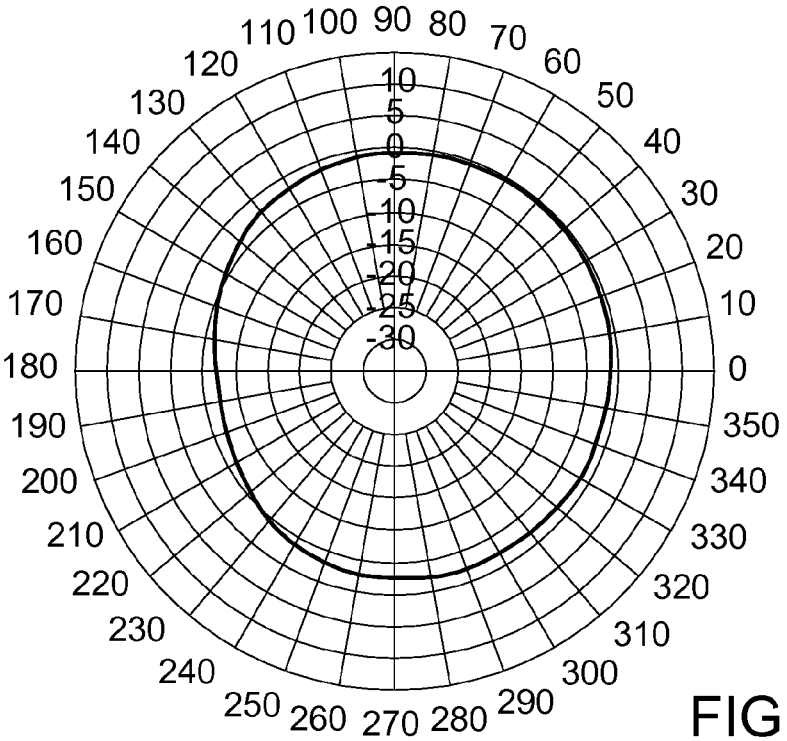
Figure 8C:
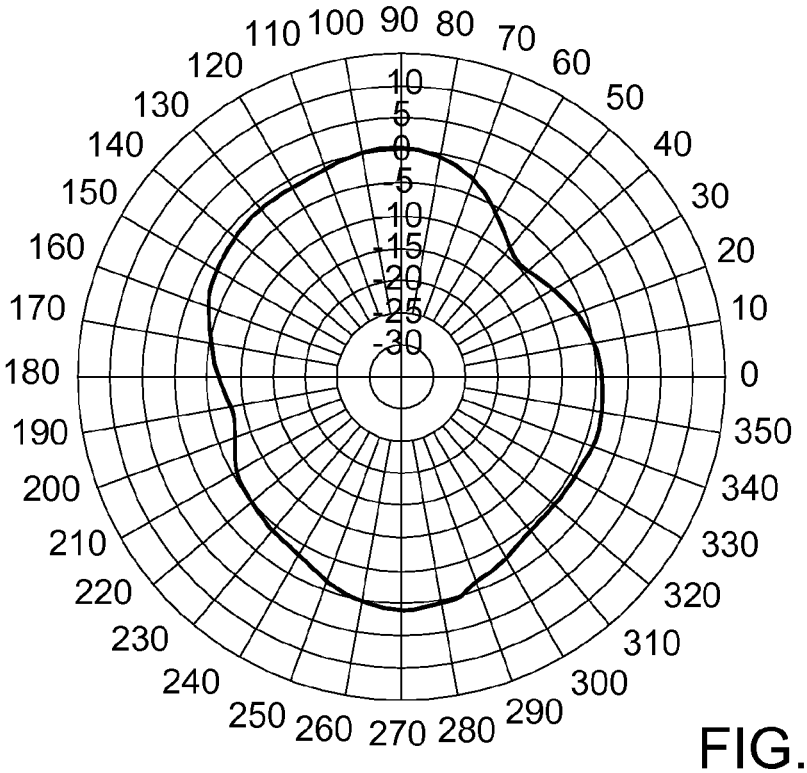
Figure 8D:
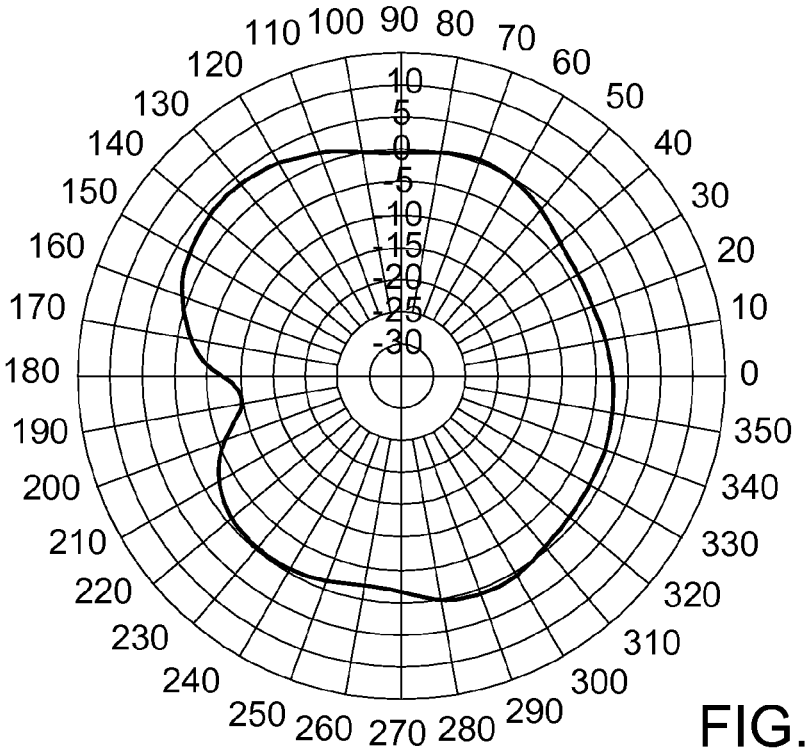
Figure 9A:
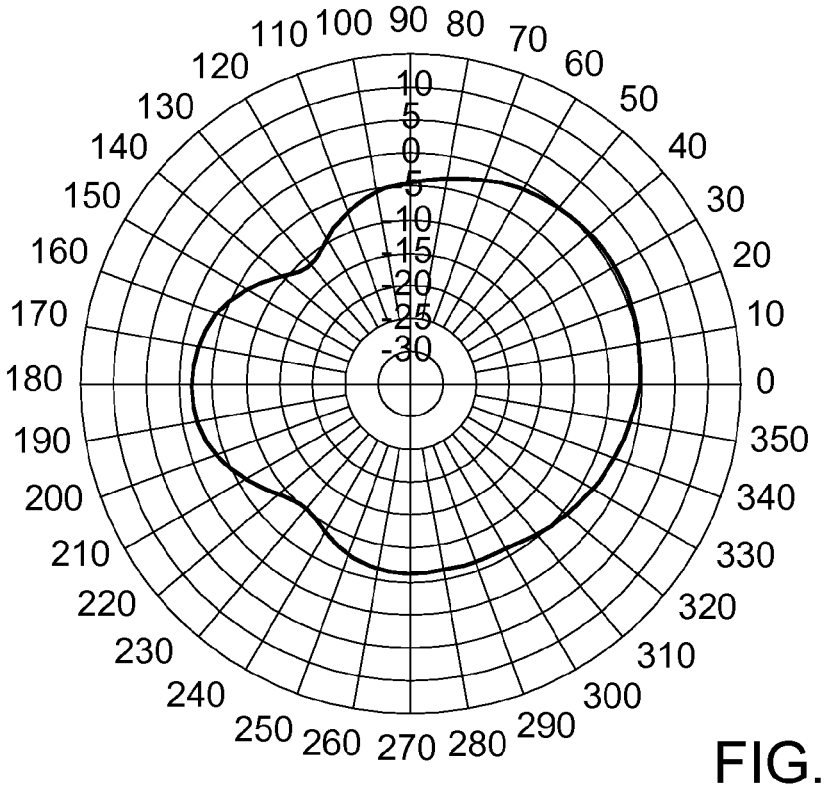
Figure 9B:
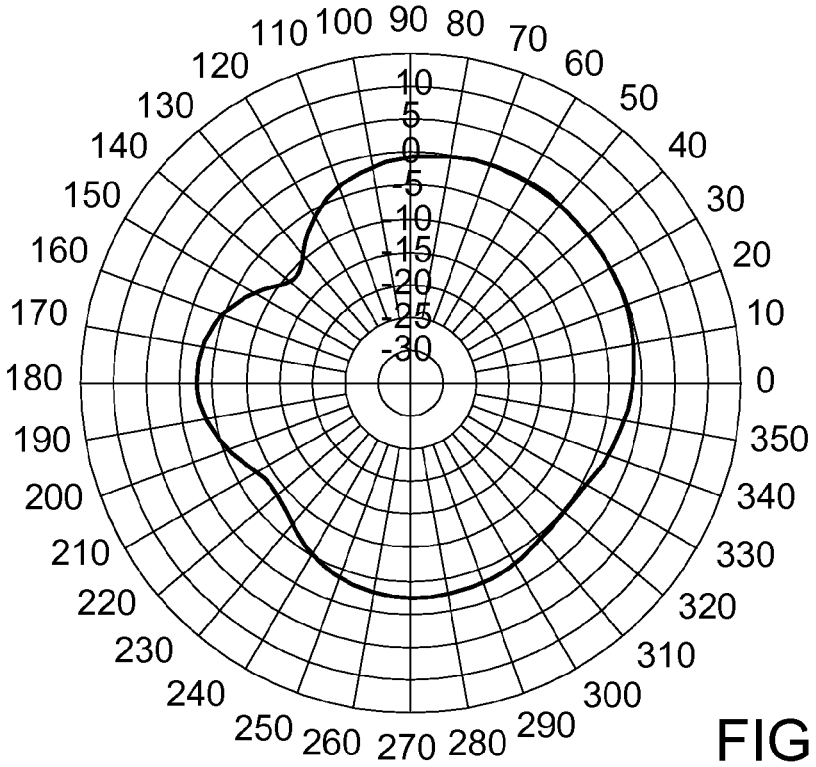
Figure 9C:
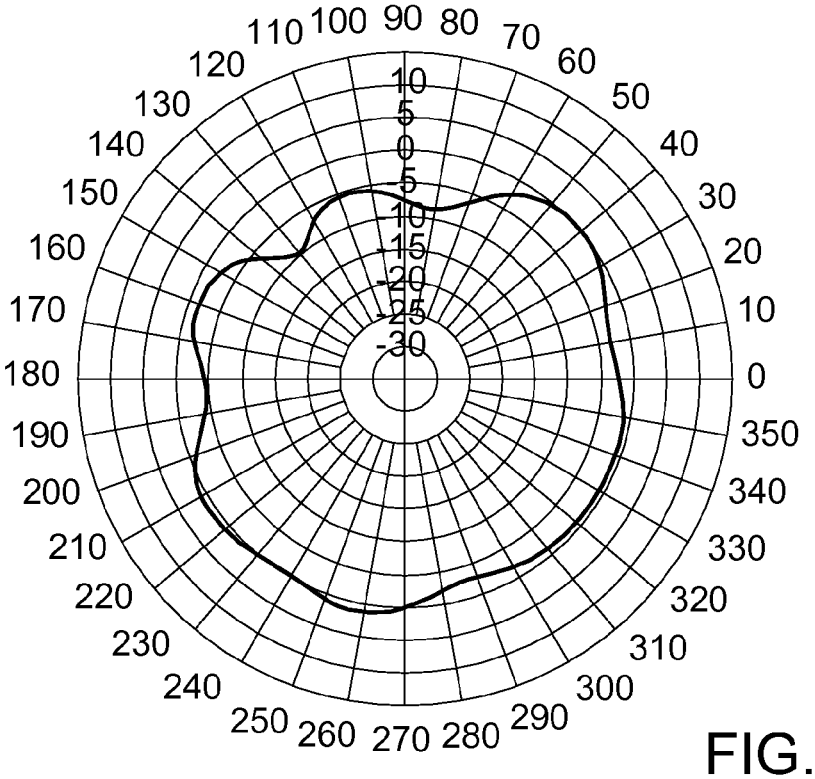
Figure 9D:
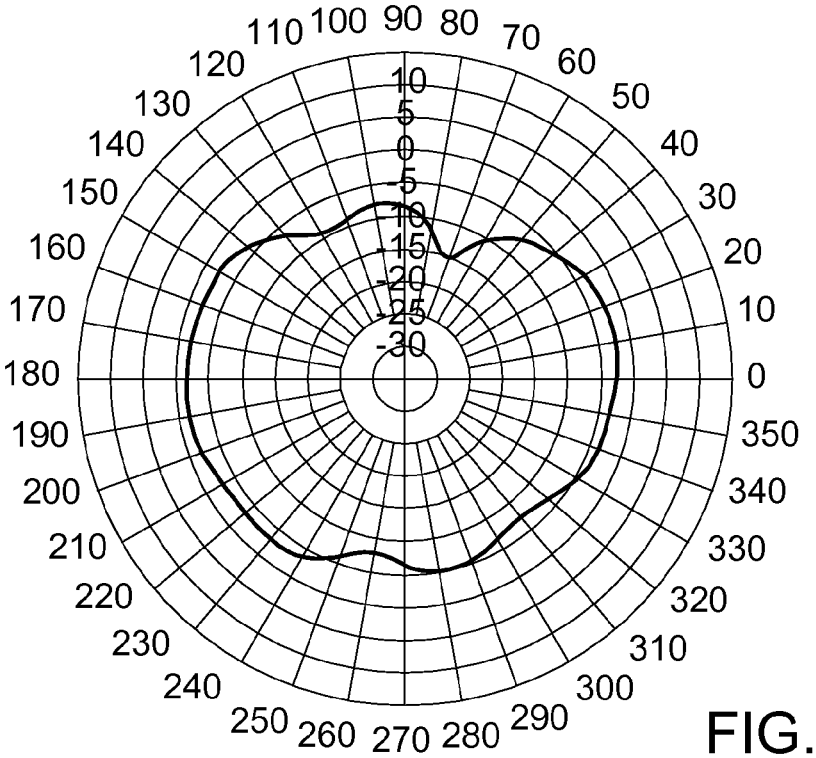

FIG. 6 shows a voltage standing wave ratio (VSWR) experiment diagram of the inverted-F antenna according the above two embodiments of the application. Compared with a reference line (VSWR=3), the inverted-F antenna of the two embodiments of the application may effectively support bands between 824 MHz~960 MHz, between 1700 MHz~18XX MHz and between 18XX MHz~2170 MHz. As indicated in FIG. 6, the inverted-F antenna of the embodiments of the application is almost an excellent multi-band antenna.

Referring to FIGS. 7A~7D, gain polarization radiation patterns on the XY plane of the inverted-F antenna according to the embodiments of the application are shown. FIGS. 7A~7D respectively show radiation patterns of total gain polarization of the inverted-F antenna operated at 824 MHz, 960 MHz, 1710 MHz and 2170 MH.

Referring to FIGS. 8A~8D, gain polarization radiation patterns on the XZ plane of the inverted-F antenna according to the embodiments of the application are shown. FIGS. 8A~8D respectively show gain polarization radiation patterns of the inverted-F antenna operated at 824 MHz, 960 MHz, 1710 MHz and 2170 MHz.

Referring to FIGS. 9A~9D, gain polarization radiation patterns on the YZ plane of the inverted-F antenna according to the embodiments of the application are shown. FIGS. 9A~9D respectively show gain polarization radiation patterns of the inverted-F antenna operated at 824 MHz, 960 MHz, 1710 MHz and 2170 MHz.

As indicated in FIGS. 7A~9D, the inverted-F antenna of the embodiments of the application have excellent gain polarization radiation patterns, which indicate excellent radiation efficiency.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A multi band antenna, comprising:

a ground plane;

a signal feeding portion, electrically isolated from the ground plane, for receiving/transmitting wireless signals;

a first main radiation part, physically and electrically connected to the signal feeding portion, for generating a first frequency band operation mode for the multi band antenna;

a second main radiation part, physically and electrically connected to the signal feeding portion, for generating a second frequency band operation mode for the multi band antenna; and a third main radiation part, extending from the ground plane, the third main radiation part electrically isolated from the signal feeding portion, the first main radiation part and the second main radiation part, the third main radiation part generating a third frequency band operation mode for the multi band antenna via a signal coupling between the first and the third main radiation parts and/or a signal coupling between the second and the third main radiation parts;

wherein the first, the second and the third main radiation parts are on a first plane;

the ground plane and the signal feeding portion are on a second plane; and the first plane and the second plane are L-shaped.

2. The multi-band antenna according to claim 1, further comprising:

a first impedance match extended from the first main radiation part for impedance match in the first frequency band operation mode.

3. The multi-band antenna according to claim 2, wherein, a slot is formed among the third main radiation part, the signal feeding portion and the ground plane, for impedance match in the third frequency band operation mode.

4. The multi-band antenna according to claim 3, further comprising a short-circuit line as a short circuit of the multi band antenna, wherein the short-circuit line is electrically connected to the ground plane, and the short-circuit line is for adjusting an impedance match of the multi band antenna.

5. The multi-band antenna according to claim 4, wherein:

the first, the second and the third main radiation parts, the first impedance match and the short-circuit line are on a first circuit board;

the slot, the ground plane and the signal feeding portion are on a second circuit board; and the first circuit board and the second circuit board are L-shaped.

6. The multi-band antenna according to claim 4, wherein, the third main radiation part further comprises a second impedance match extended from the third main radiation part, for impedance match in the third frequency band operation mode.

7. The multi-band antenna according to claim 6, wherein:

the first, the second and the third main radiation parts, the first impedance match, the second impedance match and the short-circuit line form an integral first metal piece;

the slot, the ground plane and the signal feeding portion form an integral second metal piece; and the first metal piece and the second metal piece are L-shaped.

8. The multi-band antenna according to claim 4, wherein, the first main radiation part has a meander extended towards the signal feeding portion.

9. The multi-band antenna according to claim 8, wherein, the second main radiation part is adjacent to the first main radiation part and the meander of the first main radiation part.

10. The multi-band antenna according to claim 9, wherein, the third main radiation part is adjacent to the first and the second main radiation parts.

11. The multi-band antenna according to claim 8, wherein, the first impedance match is extended away from the meander of the first main radiation part.

12. The multi-band antenna according to claim 8, wherein, the short-circuit line is electrically connected to the meander of the first main radiation part and is adjacent to the meander of the first main radiation part.

13. The multi-band antenna according to claim 1, wherein the first main radiation part has direct signal coupling with the third main radiation part; and the second main radiation part has direct signal coupling with the third main radiation part.

* * * * *